US009464336B2

(12) United States Patent
Chabot et al.

(10) Patent No.: US 9,464,336 B2
(45) Date of Patent: Oct. 11, 2016

(54) MARTENSITIC STAINLESS STEEL MACHINEABILITY OPTIMIZATION

(75) Inventors: Jean-François Laurent Chabot, Cesson (FR); Laurent Ferrer, Lieusaint (FR); Pascal Charles Emile Thoison, Mennecy (FR)

(73) Assignee: SNECMA, Paris (FR)

( * ) Notice: Subject to any disclaimer, the term of this patent is extended or adjusted under 35 U.S.C. 154(b) by 683 days.

(21) Appl. No.: 13/822,500

(22) PCT Filed: Sep. 8, 2011

(86) PCT No.: PCT/FR2011/052056

§ 371 (c)(1),
(2), (4) Date: Mar. 12, 2013

(87) PCT Pub. No.: WO2012/035240

PCT Pub. Date: Mar. 22, 2012

(65) Prior Publication Data

US 2013/0180628 A1 Jul. 18, 2013

(30) Foreign Application Priority Data

Sep. 14, 2010 (FR) ..... 10 57326

(51) Int. Cl.

| | |
|---|---|
| ***C21D 6/00*** | (2006.01) |
| ***C21D 1/18*** | (2006.01) |
| ***C21D 1/22*** | (2006.01) |
| ***C22C 38/00*** | (2006.01) |
| ***C22C 38/04*** | (2006.01) |

(Continued)

(52) U.S. Cl.
CPC ..... *C21D 6/008* (2013.01); *C21D 1/18* (2013.01); *C21D 1/22* (2013.01); *C21D 6/004* (2013.01);

(Continued)

(58) Field of Classification Search
CPC ..... C21D 1/22; C21D 6/00; C21D 2211/008
USPC ..... 148/506, 662
See application file for complete search history.

(56) References Cited

U.S. PATENT DOCUMENTS 6,090,230 A * 7/2000 Okamura ..... C21D 9/085 148/590
8,808,474 B2 * 8/2014 Ferrer ..... C21D 3/06 148/542

(Continued)

FOREIGN PATENT DOCUMENTS

| | | |
|---|---|---|
| FR | 2 872 825 | 1/2006 |
| FR | 2 893 954 | 6/2007 |
| FR | 2 920 784 | 3/2009 |

OTHER PUBLICATIONS

International Search Report Issued Nov. 17, 2011 in PCT/FR11/52056 filed Sep. 8, 2011.

*Primary Examiner* — Jie Yang
(74) *Attorney, Agent, or Firm* — Oblon, McClelland, Maier & Neustadt, L.L.P.

(57) ABSTRACT

A method of fabricating a martensitic stainless steel including: 1) heating steel to a temperature higher than austenizing temperature of the steel, then quenching the steel until a hottest portion of the steel is at a temperature less than or equal to a maximum temperature, and greater than or equal to a minimum temperature, a cooling rate being sufficiently fast for austenite not to transform into a ferrito-perlitic structure; 2) performing a first anneal followed by cooling until the hottest portion of the steel is at a temperature less than or equal to the maximum temperature and greater than or equal to the minimum temperature; 3) performing a second anneal followed by cooling to ambient temperature; and at the end of each of 1) and 2), performing: ω) as soon as temperature of the hottest portion of the steel reaches the maximum temperature, immediately heating the steel once more.

9 Claims, 1 Drawing Sheet

(51) Int. Cl.
*C22C 38/44* (2006.01)
*C22C 38/46* (2006.01)

(52) U.S. Cl.
CPC ..... *C21D 6/005* (2013.01); *C22C 38/001* (2013.01); *C22C 38/04* (2013.01); *C22C 38/44* (2013.01); *C22C 38/46* (2013.01); *C21D 2211/008* (2013.01)

(56) References Cited

U.S. PATENT DOCUMENTS

| | | | |
|---|---|---|---|
| 2008/0069719 | A1 | 3/2008 | Beguinot et al. |
| 2008/0302501 | A1 | 12/2008 | Binot et al. |
| 2010/0276038 | A1 | 11/2010 | Grellier |

* cited by examiner

MARTENSITIC STAINLESS STEEL MACHINEABILITY OPTIMIZATION

BACKGROUND OF THE INVENTION

1. Field of the Invention

The present invention relates to a method of fabricating a martensitic stainless steel including the following heat treatment steps:

1) heating the steel to a temperature higher than the austenizing temperature $T_{AUS}$ of the steel, then quenching the steel until the hottest portion of the steel is at a temperature less than or equal to a maximum temperature $T_{max}$, and greater than or equal to a minimum temperature $T_{min}$, the rate of cooling being sufficiently fast for the austenite not to transform into a ferrito-perlitic structure;

2) performing a first anneal on the steel followed by cooling until the hottest portion of the steel is at a temperature less than or equal to said maximum temperature $T_{max}$ and greater than or equal to said minimum temperature $T_{min}$; and 3) performing a second anneal of the steel followed by cooling to ambient temperature $T_A$.

Ambient temperature is equal to the temperature of the premises where the method is performed.

In the present invention, composition percentages are given as percentages by weight, unless specified otherwise.

2. Description of the Related Art

A martensitic stainless steel is a steel in which the chromium content is greater than 10.5% and in which the structure is essentially martensitic (i.e. the quantity of alphagenic elements is sufficiently high compared with the quantity of gammagenic elements—see the explanations given below).

The starting material is a semi-finished product of arbitrary shape, e.g. in the form of a billet or a bar of the steel.

The semi-finished product is then precut into sub-elements that are shaped (e.g. by forging or rolling) in order to give them a shape close to their final shape. Each sub-element thus becomes a workpiece (also referred to as a "blank") with extra thicknesses compared with the final dimensions it is to have in use.

The blank with extra thicknesses is subsequently to be machined in order to give it its final shape (finished part).

When finished parts are to possess a high degree of dimensional accuracy (e.g. in aviation), the blanks need to be subjected to heat treatment (quality heat treatment) prior to machining. This quality heat treatment cannot be performed after the machining since that would lead to changes in dimensions that are difficult to predict for parts of complex shape.

This quality heat treatment enables the properties of the steel workpiece to be adjusted very finely by performing metallurgical transformations, comprising six major stages:

A) austenization, i.e. heating to above the temperature at which the microstructure of the steel is transformed into austenite (austenitic temperature $T_{AUS}$);

B) followed by quenching;

C) followed by a first annealing treatment;

D) followed by cooling;

E) followed by a second annealing treatment; and

F) followed by cooling.

The purpose of stage A) is to homogenize the microstructure within the workpiece and to put back into solution particles that are soluble at that temperature by recrystallization.

Stage B) is for performing a first maximum transformation of austenite into martensite within the steel workpiece. Nevertheless, transformations of the martensitic microstructure do not take place simultaneously at all points within the workpiece, but gradually starting from its surface and going to its core. The changes in crystallographic volume that accompany such transformations therefore lead to internal stresses and, at the end of quenching (because of the low temperatures that are then reached), they limit the extent to which the stresses can be relaxed. The second purpose is to minimize the risk of quenching cracks appearing as a result of residual stresses being released in the steel while it is in a martensitic state having low toughness. In order to achieve these two contradictory purposes, it is common practice to begin by heating the workpiece once more in an anneal treatment (stage C)) once its hottest portion has cooled to a temperature lying in a range defined by a maximum temperature $T_{max}$ and a minimum temperature $T_{min}$ for avoiding cracking. The temperature $T_{max}$ is substantially equal to the nominal temperature $M_F$ for the end of martensitic transformation of the steel, i.e. 150° C. to 200° C. for a martensitic stainless steel. The temperature $T_{min}$ lies in the range 20° C. to 28° C. depending on chemical composition. There then remains a residual austenite content in the steel that it has not been possible to transform.

Stage C)—first annealing treatment—this quality heat treatment has the purpose firstly of transforming the fresh martensite into annealed martensite (more stable and tougher) and also of destabilizing the residual austenite from the earlier stages.

Stage D)—cooling the first anneal—this quality heat treatment is intended to transform the residual austenite into martensite. The hottest portion of the workpiece must also be cooled to a temperature in the temperature range [$T_{max}$, $T_{min}$].

Stage E)—second annealing treatment—this quality heat treatment is intended to transform the new fresh martensite into annealed martensite (more stable and tougher), seeking to achieve a better compromise in the mechanical properties of the steel.

Stage F)—cooling the second anneal—this quality heat treatment returns the blank to ambient temperature.

In spite of this quality heat treatment, while workpieces are being machined, it is found at present that there is a large amount of dispersion in the machineability of batches of workpieces made of a steel that is the result of such a fabrication method. This can lead to large variations in the amount of wear of machining inserts and in large variations in the levels of power that the machine tool needs to deliver in order to be able to machine such steel workpieces. Consequently, the consumption of machining inserts is too high, too greatly dispersed, and unpredictable, thereby giving rise to reduced rates of throughput when machining batches of workpieces, and also to dispersion in the resulting surface states, sometimes leading to workpieces with machined surface states of poorer quality.

BRIEF SUMMARY OF THE INVENTION

The present invention seeks to provide a method of fabrication that enables the machineability of such steels to be improved.

This object is achieved by the fact that the maximum temperature $T_{max}$ is less than or equal to the temperature $M_F'$ for the end of martensitic transformation on cooling in inter-dendritic spaces in said steel, and in that, at the end of each of the steps 1) and 2), the following substep is performed:

A) as soon as the temperature of the hottest portion of the steel reaches said maximum temperature Tmax, the steel is immediately heated once more.

By means of these provisions, a smaller amount of wear is achieved for machining inserts per unit machined length, and less power is required for machining purposes. The surface state of the steel after machining is also improved (stripes of smaller size resulting from the machining insert moving over the surface). This serves to reduce the cost of the method.

BRIEF DESCRIPTION OF THE SEVERAL VIEWS OF THE DRAWINGS

The invention can be well understood and its advantages appear better on reading the following detailed description of an implementation given by way of way of non-limiting example. The description refers to the accompanying drawing, in which.

DETAILED DESCRIPTION OF THE INVENTION

In the method of the invention, the starting material is a blank with extra thicknesses that has been subjected to a succession of thermomechanical treatments (such as forging, rolling) in order to give it a shape that is as close as possible to its final shape.

This blank is for subsequent machining in order to give it its final shape after it has been subjected to quality heat treatment.

The blank made of this steel is heated to a temperature higher than the austenizing temperature $T_{AUS}$, and the blank is maintained at this temperature until the entire blank is at a temperature higher than the austenizing temperature $T_{AUS}$ (austenizing the steel).

Thereafter, the steel is quenched sufficiently fast to prevent the austenite from transforming into a ferrito-perlitic structure (see FIG. 3 and the explanations given below). Thus, the major fraction of the volume of the steel blank is suitable for transforming into martensite, since austenite can be transformed into martensite only if it has not previously been transformed into a ferrito-perlitic structure.

Finally, the method terminates with two successive anneals in order to refine the properties of the steel.

Figure 1:
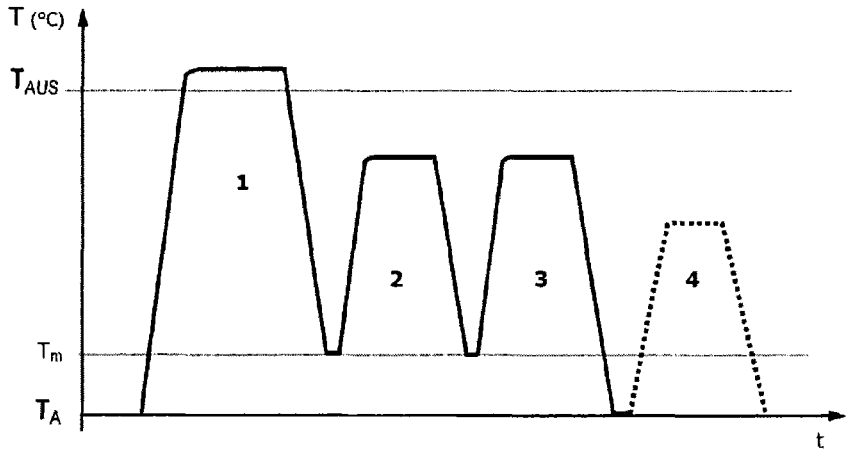
FIG. 1 is a diagram showing the heat treatments of the method of the invention.

Austenizing the steel and then quenching it correspond to treatment 1 in FIG. 1.

There follows a description of the various metallurgical transformations that can occur within a steel of the invention as it cools from the austenitic temperature.

Figure 2:
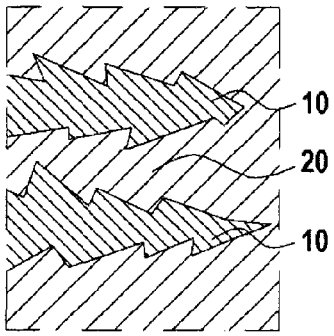
FIG. 2 is a diagram showing dendrites and inter-dendritic regions.

Upstream in the manufacturing process, during operations of preparing and making the last ingot, the steel solidifies progressively while it cools. This solidification takes place by means of dendrites 10 growing, as shown in FIG. 2. In compliance with the phase diagram for martensitic stainless steels, the dendrites 10, which correspond to the first grains to solidify, are by definition richer in alphagenic elements whereas the inter-dendritic regions 20 are richer in gammagenic elements (in application of the known segment rule to the phase diagram). An alphagenic element is an element that favors a ferritic type structure (structures that are more stable at low temperature: bainite, ferrite-perlite, martensite). A gammagenic element is an element that favors an austenitic structure (a structure that is stable at high temperature: austenite). Segregation thus occurs between dendrites 10 and inter-dendritic regions 20.

Figure 3:
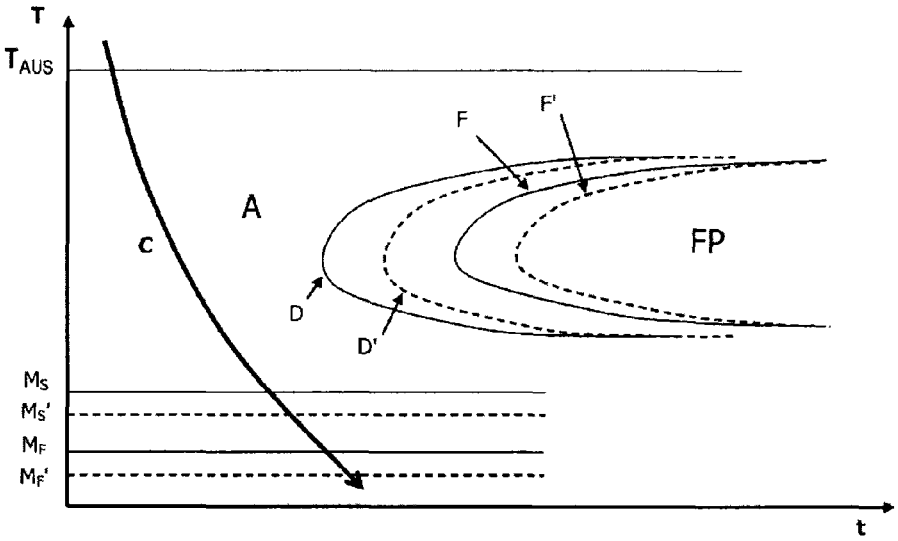
FIG. 3 is a diagrammatic time-temperature chart for a steel that is used in the method of the invention.

FIG. 3 is a known temperature (T)—time (t) chart for a steel of the invention on being cooled from a temperature higher than the austenitic temperature $T_{AUS}$. The curves D and F show the beginning and the end of the transformation from austenite (region A) to a ferrito-perlitic structure (region FP). These transformations take place in part or in full when the cooling curve C followed by the ingot passes respectively into the region between the curves D and F or into the region FP. It does not take place when the cooling curve C is situated entirely in the region A, as shown in FIG. 3.

When the cooling curve C passes below the temperature $M_S$ for the beginning of martensitic transformation on cooling (line $M_S$ in FIG. 3), the majority of the austenite that remains in the steel begins to transform into martensite. When the cooling curve passes below the temperature $M_F$ for the end of martensitic transformation on cooling (line $M_F$ in FIG. 3), the majority of the austenite remaining in the steel has been transformed into martensite, which is referred to as fresh martensite.

In FIG. 3, the curves D, F, $M_S$, and $M_F$ drawn in continuous lines are valid for structures that are richer in alphagenic elements (i.e. in the dendrites of the steel), whereas the same curves drawn in dashed lines D', F', $M_S'$, and $M_F'$ are valid for structures that are richer in gammagenic elements (i.e. in inter-dendritic spaces in the steel).

It should be observed that the curves for transforming austenite into a ferrito-perlitic structure that apply to the inter-dendritic spaces (curves D' and F') are offset to the right compared with the curves for austenite transforming into a ferrito-perlitic structure within dendrites (curves D and F). It is therefore necessary to spend a longer time at a given temperature to transform austenite into a ferrito-perlitic structure in the inter-dendritic spaces than in the dendrites.

It should be observed that the curves for transforming austenite into martensite in the inter-dendritic space (lines $M_S'$ and $M_F'$) are offset downwards relative to the curves for transforming austenite into martensite within dendrites (lines $M_S$ and $M_F$). The transformation of austenite into martensite thus takes place at temperatures that are lower in inter-dendritic spaces than within dendrites.

In the method of the invention, the cooling of the steel during quenching after austenizing (treatment that corresponds to step 1 in FIG. 1) follows the curve C in FIG. 3. Thus, the steel passes below the temperature $M_F'$ for the end of martensitic transformation on cooling in the inter-dendritic space. Given the cooling process, the temperature of the skin of the workpiece is lower than the temperature of its core, since the core is the hottest portion of the workpiece.

Once the temperature of the hottest portion of the workpiece reaches a maximum temperature $T_{max}$, which temperature is thus less than the temperature $M_F'$ for the end of martensitic transformation in inter-dendritic spaces on cooling, the workpiece is heated once more.

By way of example, this heating is performed by placing the workpiece in an environment (preheated oven or heated enclosure) in which the temperature is not less than the maximum temperature $T_{max}$.

A first anneal is then performed on the steel by continuing to heat it up to a temperature $T_R$ that is lower than the austenitic temperature $T_{AUS}$. This anneal enables the fresh martensitic crystallographic phase to be stabilized, e.g. by causing carbides to precipitate within the martensite, thereby conferring greater toughness to the martensite of the steel.

This first annealing treatment corresponds to step 2 in FIG. 1.

The steel is then cooled until the hottest portion of the steel reaches the maximum temperature $T_{max}$ that is less than the temperature $M_F'$ for the end of martensitic transformation in the inter-dendritic spaces on cooling, and then the steel is immediately heated again.

The steel is then immediately subjected to a second annealing treatment that is substantially identical to the first anneal treatment, after which the steel is allowed to cool down to ambient temperature $T_A$.

This second annealing treatment corresponds to step 3 in FIG. 1.

The inventors have performed machineability tests on martensitic stainless steels that have been subjected to the method of the invention. They have compared the results of those tests with the results of machineability tests on steels that have been subjected to austenization followed by quenching and two anneals, but in which the minimum temperature of the hottest portion of the workpiece is merely less than the temperature $M_F$ for the end of martensitic transformation on cooling in dendrites, and where the steel is not immediately heated again between the quench and the first anneal, or between the first anneal and the second anneal.

The composition of Z12CNDV12 steels is as follows (standard DMD0242-20 index E): C (0.10% to 017%)—Si (<0.30%)—Mn (0.5% to 0.9%)—Cr (11% to 12.5%)—Ni (2% to 3%)—Mo (1.50% to 2.00%)—V (0.25% to 0.40%)—$N_2$ (0.010% to 0.050%)—Cu (<0.5%)—S (<0.015%)—P (<0.025%), and satisfying the following criterion:

$$4.5 \leq (Cr-40\times C-2\times Mn-4\times Ni+6\times Si+4\times Mo+11\times V-30\times N) < 9$$

The inventors have found that with a steel fabricated using the method of the invention, the wear of machining inserts per meter of machined steel is divided by about 10 (going from 11 millimeters (mm) to 1.3 mm) for a cutting speed of 120 meters per minute (m/min) as compared with a steel fabricated using a prior art method. The power required for machining is also divided by more than 2 compared with a steel fabricated using a prior art method. The surface state of the steel after machining is also improved.

In particular, with a maximum temperature $T_{max}$ lying in the range 28° C. to 35° C., the wear of the machining inserts per unit length of machined steel is divided by 15, and the power required for machining is divided by 2.5. A maximum temperature $T_{max}$ lying in the range 20° C. and 75° C. also gives good results.

When the maximum temperature $T_{max}$ is above 90° C. (and up to 180° C.) the machining results are very bad.

Medium results (intermediate between the good and the bad results) are to be found when the steel is heated as soon as the hottest portion of the workpiece reaches a temperature beyond 180° C. (up to 300° C.)

According to the inventors, the results can be explained as follows: as mentioned above, the temperature $M_F'$ for the end of martensitic transformation on cooling in inter-dendritic regions is lower than the temperature $M_F$ for the end of martensitic transformation on cooling in dendrites. However, it has been seen that during the cooling of the steel, the steel solidifies into a microstructure of alternating dendrites and inter-dendritic regions (FIG. 2). Thus, when the temperature drops below the temperature $M_F$ for the end of martensitic transformation on cooling in dendrites, the dendrites have finished transforming into martensite, whereas the inter-dendritic regions have not yet finished transforming into martensite. Thus, if the steel is heated again as soon as it has reached the temperature $M_F$ for the end of martensitic transformation on cooling in dendrites, there remain zones throughout the steel (i.e. the inter-dendritic regions) that contain residual austenite. Some of this residual austenite transforms into fresh martensite during the following step of the first anneal. The remainder of this residual austenite is located solely in the points of the material that are the most segregated (e.g. in the most concentrated inter-dendritic spaces).

During the second anneal, the new fresh martensite stabilizes, but another portion of the remaining residual austenite continues to transform into fresh martensite in those most segregated locations. The steel thus presents structural non-uniformity with harder grains corresponding to the fresh martensite within a softer matrix. It is this non-uniformity that is responsible for the poor machineability of the steel, with the harder grains wearing the inserts by blocking their advance.

Conversely, if the steel is heated as soon as the hottest portion of the workpiece reaches a high temperature (lying in the range 180° C. to 300° C.), residual austenite is conserved, which ends up producing medium behavior during subsequent machining.

It can thus be understood why cooling the steel to the temperature $M_F'$ for the end of martensitic transformation on cooling in the inter-dendritic regions, followed by immediately heating the steel again as soon as it has reached this temperature $M_F'$, makes it possible to obtain a microstructure within the steel that is more homogenous.

For example, the maximum temperature $T_{max}$ reached by the hottest portion of the steel before being heated once more lies in the range 20° C. to 75° C. Such a temperature $T_m$ is lower than the temperature $M_F'$ for the end of martensitic transformation on cooling in the inter-dendritic spaces.

For example, this maximum temperature $T_{max}$ may lie in the range 28° C. to 35° C.

In order to determine when the hottest portion of the steel has reached the maximum temperature $T_{max}$, it is possible, for example, in step ω) to measure the temperature of the skin of the steel and to make use of charts in order to deduce therefrom the temperature of the hottest portion of the steel.

It is also advantageous for the temperature gradient between the surface of the steel and the hottest portion of the steel to be as small as possible, so as to reduce the difference between the temperature $M_F$ for the end of martensitic transformation on cooling in dendrites and the temperature $M_F'$ for the end of martensitic transformation on cooling in inter-dendritic spaces. By reducing this difference, stresses within the workpiece are reduced and productivity is improved.

Thus, advantageously, in each of the steps 1) and 2), the following substep is performed before the substep A):

B) as soon as the temperature of the hottest portion of the steel reaches a threshold temperature $T_s$ lower than the temperature $M_S$ for the start of martensitic transformation on cooling in dendrites in said steel, and higher than the temperature $M_F'$ for the end of martensitic transformation on cooling in inter-dendritic spaces, the steel is maintained in an environment in which there substantially exists a temperature lying between the minimum temperature $T_{min}$ and the temperature $M_F'$ for a threshold duration ds so as to reduce the temperature gradient between the surface of the steel and the hottest portion of the steel.

The threshold duration $d_s$ depends on the shape of the workpiece. The duration $d_s$ is at least 15 minutes (min) for a minimum dimension of the workpiece of 50 mm, 30 min for a minimum dimension of the workpiece of 100 mm, 45 min for a minimum dimension of the workpiece of 150 mm, and so on. For a minimum dimension of the workpiece lying between these values, it is possible to deduce the duration $d_s$ from that minimum dimension, for example by extrapolating using the following formula:

$$d_s=(15\text{ min})\times\{\text{minimum dimension (in mm)}\}/50$$

In order to maintain the steel in an environment in which there substantially exists a temperature lying between the minimum temperature $T_{min}$ and the temperature $M_F'$, it is possible for example to place the steel in an oven in which there exists a temperature lying in the range $T_{min}$ to $M_F'$.

Alternatively, the steel may be thermally isolated from the outside environment, e.g. by placing it in a blanket.

Advantageously, after the second anneal, the steel is relaxed at least once at a temperature lower than the anneal temperatures $T_R$ at which the first and second anneals were performed.

This relaxation corresponds to step 4 in FIG. 1. It serves to relax residual stresses within the steel, and thereby improve its lifetime.

In order to improve the fatigue strength of steels of the invention, it is desirable to increase the inclusion cleanliness of the steel, i.e. to reduce the quantity of undesirable inclusions (certain alloy phases, oxides, carbides, intermetallic compounds) that are present in the steel. These inclusions act as sites for starting cracks that lead, under cyclic stressing, to premature failure of the steel.

Methods are known for improving inclusion cleanliness, in particular a remelting method such as electro-slag refusion (ESR) or vacuum arc remelting (VAR). These methods are known, so only their overall operation is summarized below.

The ESR method consists in placing a steel ingot in a crucible into which a slag is poured (a mineral mixture, e.g. lime, fluorides, magnesia, alumna, fluorspar) so that the bottom end of the ingot is immersed in the slag. Thereafter an electric current is passed through the ingot, which acts as an electrode. The current liquefies the slag and melts the bottom end of the electrode that is in contact with the slag. The molten steel from the electrode passes through the slag in the form of fine droplets and solidifies beneath the supernatant layer of slag, thereby forming a new ingot that thus grows progressively. The slag acts, amongst other ways, as a filter that extracts the inclusions from the droplets of steel, such that the steel of the new ingot situated under the layer of slag contains fewer inclusions than the initial ingot (electrode). This operation is performed at atmospheric pressure and in air.

The VAR method consists in melting the steel ingot in a crucible under a high vacuum, the ingot acting as an electrode. The ingot/electrode is melted by establishing an electric arc between the end of the ingot/electrode and the top of the secondary ingot that is formed by melting the ingot/electrode. The secondary ingot solidifies on contact with the walls of the crucible and the inclusions float to the surface of the secondary ingot, from which they can subsequently be eliminated. A secondary ingot is thus obtained presenting greater purity than the initial ingot/electrode.

Advantageously, prior to step 1), the steel is subjected to remelting.

For example, the remelting may be selected from a group comprising electro-slag refusion (ESR) and vacuum arc remelting (VAR).

Advantageously, before step 1), a steel homogenization treatment is performed.

During this homogenization, alloy elements diffuse from zones of high concentration to zones of low concentration. This serves to reduce the intensity of alphagenic element segregation in the dendrites 10, and to reduce the intensity of gammagenic element segregation in the inter-dendritic regions 20. Reducing the intensity of segregation for these gammagenic elements has the particular consequence of bringing the temperature $M_F$ for the end of martensitic transformation on cooling in dendrites closer to the temperature $M_F'$ for the end of martensitic transformation on cooling in inter-dendritic spaces, and also to a smaller structural difference between the dendrites 10 and the inter-dendritic regions 20.

Concerning the features of the homogenization treatment, the inventors have found that satisfactory results are obtained when the ingot is subjected in the oven to homogenization treatment for a holding time $\underline{t}$ after the temperature of the coldest point in the ingot has reached a homogenization temperature T, this holding time $\underline{t}$ being equal to at least one hour, and the homogenization temperature T lying between a lower temperature $T_{inf}$ and the burning temperature of the steel.

The temperature $T_{inf}$ is equal to about 900° C. The burning temperature of a steel is defined as the temperature in the raw solidification state at which the grain boundaries in the steel transform (i.e. become liquid), and it is higher than $T_{inf}$. This time $\underline{t}$ for holding the steel in the oven thus varies inversely with the homogenization temperature T.

For example, with a martensitic stainless steel Z12CNDV12 (AFNOR standard) as used by the inventors during testing, the homogenization temperature T is 950° C., and the corresponding holding time $\underline{t}$ is equal to 70 hours. When the homogenization temperature T is equal to 1250° C., which is slightly below the burning temperature, then the corresponding holding time $\underline{t}$ is equal to 10 hours.

In another implementation of the invention, in order to improve the machineability of martensitic stainless steels, it is possible to perform homogenization treatment of the steel as described above and then to perform steps 1), 2), and 3) of the prior art without performing the substep ω). In this implementation, the maximum temperature $T_{max}$ is lower than the temperature $M_F$ for the end of martensitic transformation on cooling in dendrites in the steel, and in the steps 1) and 2), it is ensured that the steel remains at a temperature that is equal to or less than the maximum temperature $T_{max}$ for a time that is as short as possible.

The invention claimed is:

1. A method of fabricating a martensitic stainless steel comprising:

1) heating steel to a temperature higher than austenizing temperature of the steel, then quenching the steel until a hottest portion of the steel is at a temperature less than or equal to a maximum temperature, and greater than or equal to a minimum temperature, a rate of cooling being sufficiently fast for austenite not to transform into a ferrito-perlitic structure;

2) performing a first anneal on the steel followed by cooling until the hottest portion of the steel is at a temperature less than or equal to the maximum temperature and greater than or equal to the minimum temperature; and 3) performing a second anneal of the steel followed by cooling to ambient temperature;

wherein the maximum temperature is less than or equal to the temperature for an end of martensitic transformation on cooling in inter-dendritic spaces in the steel, and, at an end of each of 1) and 2), performing:

A) as soon as temperature of the hottest portion of the steel reaches the maximum temperature, immediately reheating the steel, and wherein, in each of 1) and 2), further comprising performing, before A):

B) as soon as the temperature of the hottest portion of the steel reaches a threshold temperature lower than the temperature for the start of martensitic transformation on cooling in dendrites in the steel, and higher than the temperature for the end of martensitic transformation on cooling in inter-dendritic spaces, maintaining the steel in an environment in which there substantially exists a temperature lying between the minimum temperature and the temperature for a threshold duration so as to reduce a temperature gradient between a surface of the steel and the hottest portion of the steel.

2. A method of fabricating a martensitic stainless steel according to claim 1, wherein the maximum temperature is in a range of 20° C. to 75° C.

3. A method of fabricating a martensitic stainless steel according to claim 2, wherein the maximum temperature is in a range of 28° C. to 35° C.

4. A method of fabricating a martensitic stainless steel according to claim 1, wherein, in A), the temperature of a skin of the steel is measured and charts are used to deduce therefrom the temperature of the hottest portion of the steel.

5. A method of fabricating a martensitic stainless steel according to claim 1, wherein after 3), the steel is subjected to relaxation at least once at a temperature lower than the annealing temperatures at which the first anneal of 2) and the second anneal of 3) were performed.

6. A method of fabricating a martensitic stainless steel according to claim 1, wherein, in B), the steel is placed in an oven having a temperature in a range of the minimum temperature to the temperature for the threshold duration.

7. A method of fabricating a martensitic stainless steel according to claim 1, wherein prior to 1), the steel is subjected to remelting.

8. A method of fabricating a martensitic stainless steel according to claim 1, wherein prior to 1), a homogenization treatment is performed on the steel.

9. A method of fabricating a martensitic stainless steel according to claim 1, wherein the composition of the steel is C 0.10 wt % to 0.17 wt % —Si<0.30 wt % —Mn 0.5 wt % to 0.9 wt % —Cr 11 wt % to 12.5 wt % —Ni 2 wt % to 3 wt % —Mo 1.50 wt % to 2.00 wt % 13 V 0.25 wt % to 0.40 wt % —$N_2$ 0.010 wt % to 0.050 wt % —Cu <0.5 wt % —S<0.015 wt % —P<0.025 wt %—balance Fe, and satisfying the following criterion:

$$4.5<Cr-40\times C-2\times Mn-4\times Ni+6\times Si4\times Mo+11\times V-30\times N<9.$$

* * * * *